United States Patent [19]

Holladay

[11] Patent Number: 4,681,291

[45] Date of Patent: Jul. 21, 1987

[54] BOOK HOLDER

[76] Inventor: Wilfred E. Holladay, 18536 Mescal, Rowland Heights, Calif. 91748

[21] Appl. No.: 879,017

[22] Filed: Jun. 26, 1986

[51] Int. Cl.[4] ..... A47B 97/04

[52] U.S. Cl. ..... 248/444.1; 248/451

[58] Field of Search ..... 248/444.1, 441.1, 450, 248/458, 444, 451, 452, 453, 459; 281/45, 46

[56] References Cited

U.S. PATENT DOCUMENTS

| | | | |
|---|---|---|---|
| 1,454,182 | 5/1923 | Myer | 281/46 |
| 3,272,183 | 9/1966 | Craighead | 248/441.1 X |
| 3,833,197 | 9/1974 | Dyke | 248/441.1 |
| 4,572,546 | 2/1986 | Morrison | 281/45 |
| 4,589,682 | 5/1986 | Balland | 281/46 |

FOREIGN PATENT DOCUMENTS

| | | | |
|---|---|---|---|
| 516365 | 1/1953 | Belgium | 281/45 |

*Primary Examiner*—J. Franklin Foss

*Attorney, Agent, or Firm*—Edgar W. Averill, Jr.

[57] ABSTRACT

A book holder affixed to a book for holding the book in an open and readable position. The book holder has a transparent face sheet which extends over the surface of both open pages of the book. The book holder has a second page holding sheet which is affixed along one edge of the transparent face sheet and extends under a plurality of the pages of the book.

5 Claims, 6 Drawing Figures

FIG. 1.
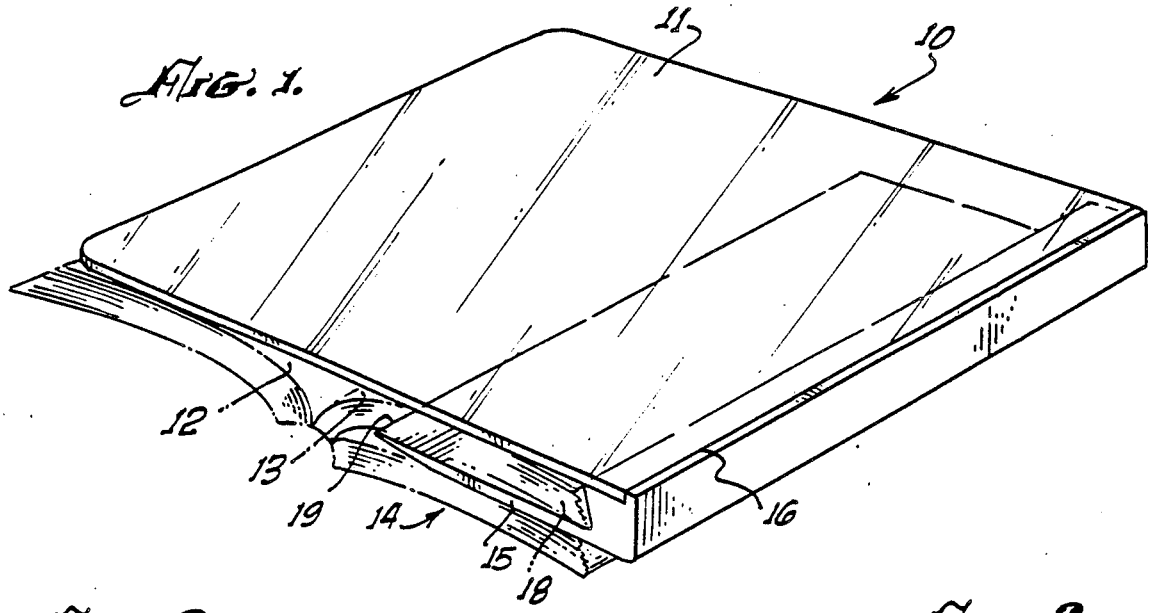
FIG. 2.
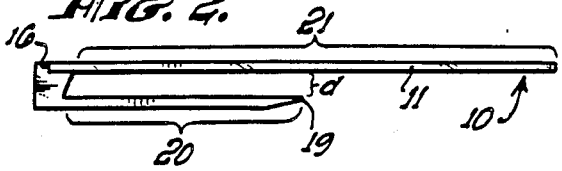
FIG. 3.
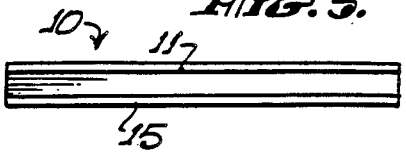
FIG. 4.
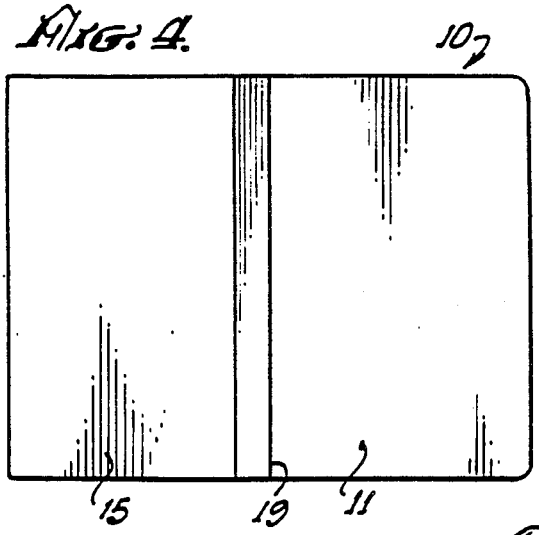
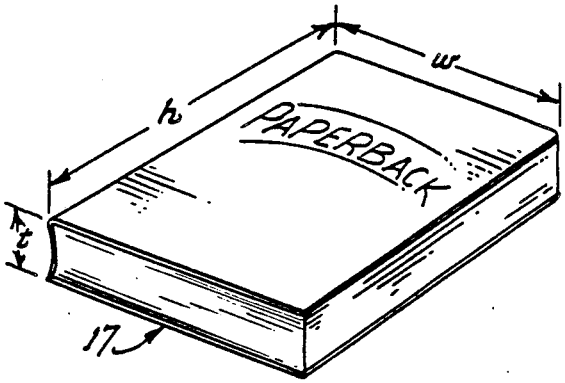
FIG. 6.
FIG. 5.
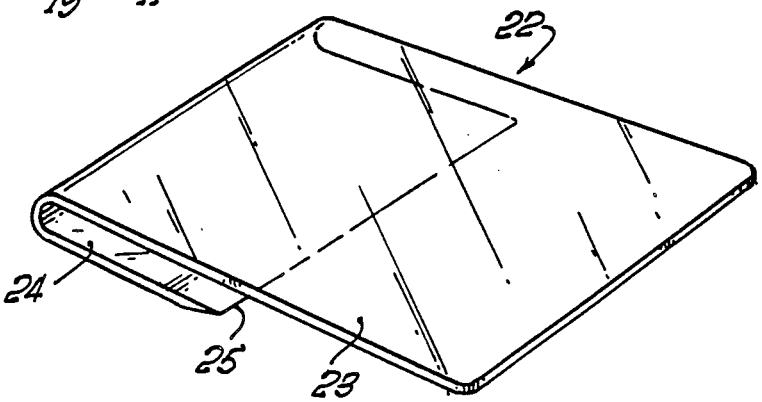

BOOK HOLDER

BACKGROUND OF THE INVENTION

The field of the invention is reading aids and the invention relates more particularly to devices which hold books in a manner which allows them to be read without the use of either hand as, for instance, resting in the lap or on a table top.

Book holders have been commonly used for cookbooks since it is often inconvenient for the user to hold the book open with his or her hands. Therefore, transparent, plastic troughs have been devised into which a book may be placed in an open position and held so that the recipe may be read without touching the book. Such book holders, however, are typically cumbersome and not adaptable for use for paperback books of the type commonly referred to as "pocketbooks." There has been, for some time, a need for a device which will facilitate the reading of a book either by persons who have limited use of their hands or for people who wish to read while both hands are occupied.

SUMMARY OF THE INVENTION

It is an object of the present invention to provide a book holder for use on paperback books, and the like, which enable a reader to hold the book open in a readable position on a surface without the use of either hand.

The present invention is for a book holder affixed to a book for holding the book in an open and readable position on a surface. The book holder and book combination includes a book having a width, a height and a thickness. The book holder has a transparent face sheet made from a rigid and transparent sheet. The face sheet has a height about equal to the height of the book and a width of about equal to twice that of the book. The book holder has a page holding sheet made from a rigid material and affixed along one edge to one edge of the transparent face sheet. The page holding sheet extends in the same direction as the transparent face sheet but has a width of less than that of the transparent face sheet. Preferably, the width is less than about one-half of that of the transparent face sheet. The page holding sheet is spaced a distance from the transparent face sheet less than one-half of the thickness of the book.

BRIEF DESCRIPTION OF THE DRAWINGS

FIG. 1 is a perspective view of the book holder of the present invention secured to a book.

FIG. 2 is a side elevation of the book holder of FIG. 1.

FIG. 3 is an end view thereof.

FIG. 4 is a bottom view thereof.

FIG. 5 is a perspective view of an alternate configuration thereof.

FIG. 6 is a perspective view of a paperback book useful with the book holder of the present invention.

DESCRIPTION OF THE PREFERRED EMBODIMENTS

The book holder of the present invention is shown in perspective view in FIG. 1 and indicated by reference character 10. Book holder 10 has a rigid, transparent face sheet 11 which extends, essentially, completely over the two open pages 12 and 13 of book 14.

Book holder 10 has a page holding sheet 15 which is secured along one edge 16 of face sheet 11. As seen best in FIG. 2, page holding sheet 15 is secured in a parallel manner to face sheet 11 and is spaced a distance indicated by reference character "d" therefrom. Distance "d" should be less than one-half of the thickness of the book. For instance, paperback book 17, shown in FIG. 6, has a thickness "t," a height "h" and a width "w." Thus, the distance "d" should be less than about one-half "t." In this way, the pages can be inserted between page holding sheet 15 and face sheet 11 in a snug manner at any point in the book. That is, if the reader is exactly half way through the book, either the read or the unread pages may be placed between the two sheets in a snug manner as indicated in FIG. 1. It should be noted that some space may exist between the pages and the face sheet as the fold at the binding of the book will help to hold it in place. The height of both the face sheet 11 and the page holding sheet 15 is measured along the same dimension as "h" in FIG. 6 and the width is measured in the same direction as "w" in FIG. 6. The captured pages are indicated by reference character 18 and these may be readily slid between the two sheets by merely placing the book holder on top of the open book and sliding it inwardly. Preferably, the edge 19 of page holding sheet 15 is thin so that it may be readily inserted between the pages. Most paperback books are between one-half and one inch thick. Thus, a preferred dimension for the opening width "d" is between one-quarter and one-half inch, and three-eighths of an inch is a preferred spacing.

It is also preferable that the width 20 of page holding sheet 15 be less than one-half the width 21 of the face sheet. In this way, the edge 19 of page holding sheet 15 will not touch the inner edge of a page. It is also appropriate that the width of face sheet 21 be about twice the width "w" of the book so that it completely covers both open pages 12 and 13 as indicated in FIG. 1. This facilitates the reading of the book through face sheet 11 without having an interface where the printed word extends past face sheet 11. It would, of course, not be detrimental that face sheet 11 extends slightly beyond open page 12, but it should not be terminated before the edge of open page 12.

Face sheet 11, preferably, has a non-glare surface and should be made from a material of high transparency. Acrylic plastics are readily available with such characteristics and are recommended although other materials having the property of transparency can be used. The transparent face sheet should be rigid to the extent that it must hold down the open pages of the book. The term "rigid" as used herein refers only to that degree of rigidity necessary to perform this function. It has been found that an acrylic sheet having a thickness of one-eighth of an inch is very satisfactory as a face sheet. The page holding sheet 15, of course, need not be transparent, although, as shown in FIG. 5, may be fabricated from the same material as the face sheet. In FIG. 5, book holder 22 has a transparent face sheet 23 and a page holding sheet 24 with a sharpened edge 25. Once again, page holding sheet 24 is less than one-half the width of face sheet 23.

The book holder may be inserted over either half of the book. That is, when one begins a book, the book holder would be inserted over the unread pages since it is preferably used where the captured pages 18 about fill the distance between face sheet 11 and page holding sheet 15. In this way, the captured pages actually provide the weight to hold the book holder to the book. As the book is approximately half read, then the book holder can be used either to capture read pages or unread pages. As the book nears completion, then the captured pages would necessarily become the read pages and, in any event, the book holder can be used at any point of reading of the book. The holder permits the easy reading of the book, for instance, during dining or when both hands are occupied in, for instance, a repair task. Furthermore, simply for comfort, the book may be placed in the reader's lap and the book holder, because of its light weight, greatly facilitates the holding of the book. To turn a page, the book holder is slipped off of the captured pages, the page turned, and then reinserted over the captured pages. This may be done readily with one hand.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A book holder affixed to a book for holding said book in an open and readable position on a surface comprising:

an open book having left and right hand open halves, a closed width and an open width equal to about twice the closed width, a height and a thickness;

a book holder having a transparent face sheet made from a rigid and transparent sheet, said face sheet having a height about equal to the height of said book and a width about equal to the open width of the book, said book holder having a page holding sheet made from a rigid material and affixed along one edge to one edge of said transparent face sheet and extending in a parallel manner thereunder and spaced therefrom a distance of less than one-half of the thickness of the book and having a width of less than the face sheet, said transparent face sheet extending over the open pages of the book and the pages of only one of said left or right hand open halves being inserted between the transparent face sheet and the page holding sheet.

2. The book holder of claim 1 wherein the outer edge of the page holding sheet is thin to facilitate its insertion between the pages of said book.

3. The book holder of claim 1 wherein the transparent face sheet is about one-eighth inches thick.

4. The book holder of claim 1 wherein the outer surface of said transparent face sheet has a non-glare surface thereon.

5. The book holder of claim 1 wherein the page holding sheet has a width of less than one-half of that of the transparent face sheet.

* * * * *